US005829695A

United States Patent [19]

Sakato et al.

[11] Patent Number: 5,829,695

[45] Date of Patent: Nov. 3, 1998

[54] CRUSHING MACHINE

[75] Inventors: Seiichi Sakato; Masayuki Sakato, both of Chiba-ken, Japan

[73] Assignee: Kabushiki Kaisha Sakato Kosakusho, Chiba-ken, Japan

[21] Appl. No.: 742,316

[22] Filed: Nov. 1, 1996

[51] Int. Cl.[6] ..... B02C 1/10

[52] U.S. Cl. ..... 241/101.73; 241/266; 241/291

[58] Field of Search ..... 241/262, 266, 241/101.72, 101.73, 264, 291, 300; 30/134, 167.1, 168; 81/436

[56] References Cited

U.S. PATENT DOCUMENTS

| | | | |
|---|---|---|---|
| 4,890,798 | 1/1990 | Tagawa et al. | 241/101.73 X |
| 4,961,543 | 10/1990 | Sakato et al. | 241/101.73 X |
| 5,292,079 | 3/1994 | Zakohji | 241/264 |
| 5,361,999 | 11/1994 | Sakato et al. | 241/101.72 |
| 5,474,242 | 12/1995 | Rafn | 241/101.73 X |
| 5,533,682 | 7/1996 | de Geir et al. | 241/266 X |
| 5,645,236 | 7/1997 | Sugiura et al. | 241/266 |

FOREIGN PATENT DOCUMENTS

| | | | |
|---|---|---|---|
| 60-43513 | 9/1985 | Japan . | |
| 102441 | 8/1963 | Norway | 30/167.1 |
| 2 190 856 | 12/1987 | United Kingdom | 241/266 |

*Primary Examiner*—Mark Rosenbaum

*Attorney, Agent, or Firm*—Lowe Hauptman Gopstein Gilman & Berner

[57] ABSTRACT

A crushing machine for crushing such as concrete structural members of buildings includes: a crushing machine outer casing; a fixed jaw body provided fixedly on the crushing machine outer casing; and a movable jaw body provided movably on the crushing machine outer casing to effect an opening and closing operation in cooperation with the fixed jaw body; wherein a crushing blade formed substantially in a shape of a semicircular cutting blade is provided at a distal end of the movable jaw body. The crushing blade includes a rear-side edge which is formed in a substantially right-angled shape with a small arcuate edge portion located at an angled portion thereof and a front-side edge which as a whole is generally formed by a large arcuate edge portion. The rear-side edge is located at a position closer to a longitudinally inward direction side of the movable jaw body relative to the front-side edge.

10 Claims, 15 Drawing Sheets

CRUSHING MACHINE

BACKGROUND OF THE INVENTION

1. Field of the Invention

The present invention relates to a crushing machine which is used as a principal section of an apparatus for demolishing structures (buildings and the like) made of such as reinforced concrete, and which is capable of efficiently crushing concrete structural members such as reinforced concrete walls, floors, ceilings, and pillars.

2. Description of the Related Art

In recent years, there are various types of crushing machines for crushing concrete structural members such as walls and pillars of structures (buildings and the like) made of such as reinforced concrete. Many of these crushing machines are each arranged such that a fixed jaw and a movable jaw are provided in such a manner as to be freely opened or closed by a hydraulic cylinder mechanism or the like, and cutting blades which are opened or closed together with the fixed jaw and the movable jaw are respectively provided on the fixed jaw and the movable jaw so as to crush and cut the concrete structural members.

As such a cutting blade, one which is formed substantially in the shape of a half-split bead of a soroban, i.e., an abacus, (in the shape of a semicircular cutting blade) is used widely, as disclosed in Japanese Patent Application Publication No.43513/1975. The mechanism of this cutting blade formed substantially in the shape of a half-split bead of a soroban operates such that, during the crushing of a concrete structural member, the cutting blade first bites into the concrete structural member, which is clamped by the fixed jaw and the movable jaw, in the manner of a wedge, the concrete structural member then becomes cracked as the depth of the bite becomes deeper, and the concrete structural member is crushed as the cracks become wider. In particular, among the cutting blades formed substantially in the shape of a half-split bead of a soroban, there is a type in which its side elevational shape is not completely semicircular but trapezoidal, and its front edge side is substantially right-angled, while its rear edge side is formed in the shape of a circular arc, as shown in FIGS. 16 and 17. This type of crushing blade formed substantially in the shape of a half-split bead of a soroban is provided such that an arcuate blade portion on the rear edge side thereof opposes the fixed jaw located therebelow.

With such a crushing blade formed substantially in the shape of a half-split bead of a soroban, the crushing blade formed substantially in the shape of a half-split bead of a soroban pierces and at the same time cuts the concrete structural member as described above, thereby making it possible to crush the concrete structural member such as a wall, a pillar, and the like. In particular, in the case of the type in which its side elevational shape is trapezoidal with its front edge side formed in a substantially right-angled shape and with its overall rear edge side formed substantially in the shape of a circular arc, when the movable jaw is closed to clamp the concrete structural member in cooperation with the fixed jaw, the rear edge side of the crushing blade is first brought into contact with the concrete structural member to crush the concrete structural member. Then, the arcuate blade portion pierces the surface of the concrete structural member over a relatively large range, and makes it possible to crush the concrete structural member while cracking that portion of the concrete structural member almost instantly. The crushing blade of this type is very effective in a case where the internal structure of the concrete structural member itself has become relatively fragile.

However, among the concrete structural members, particularly in the case of a concrete structural member in which the density of a concrete component is high, the concrete structural member is very hard, and resistance during crushing may be very large. When such a particularly hard concrete structural member is crushed, in the case of the crushing blade with its overall rear edge side formed substantially in the shape of a circular arc, a portion of contact between the crushing blade and the surface of the concrete structural member during an initial period of crushing becomes large, and assumes a state of line contact. Hence, the force for crushing is dispersed at the contact surface which is in the state of line contact, and the crushing force becomes small at a unit area, thereby making it very difficult to effect crushing. Further, with the conventional types of crushing machines, slippage can occur when a concrete structural member is crushed, so that the concrete structural member is frequently dislocated from the fixed jaw and the movable jaw, thereby hampering the crushing operation.

SUMMARY OF THE INVENTION

Accordingly, it is an object of the present invention to provide a crushing machine which is capable of enhancing the crushing efficiency by using a concentrated load system based on a state of point contact, even with respect to a particularly hard concrete structural member encountered in the crushing of a structure.

To this end, in accordance with a first aspect of the present invention, there is provided a crushing machine comprising: a crushing machine outer casing; a fixed jaw body provided fixedly on the crushing machine outer casing; and a movable jaw body provided movably on the crushing machine outer casing to effect an opening and closing operation in cooperation with the fixed jaw body; wherein a crushing blade formed substantially in a shape of a semicircular cutting blade is provided at a distal end of the movable jaw body, the crushing blade including a rear-side edge which is formed in a substantially right-angled shape with a small arcuate edge portion located at an angled portion thereof and a front-side edge which as a whole is generally formed by a large arcuate edge portion, the rear-side edge being located at a position closer to a longitudinally inward direction side of the movable jaw body relative to the front-side edge.

In accordance with the above-described first aspect of the present invention, since the crushing blade, which includes the rear-side edge formed in a substantially right-angled shape with a small arcuate edge portion located at an angled portion thereof and the front-side edge which as a whole is generally formed by a large arcuate edge portion, is provided at a distal end of the movable jaw body, and since the rear-side edge is located at a position closer to a longitudinally inward direction side of the movable jaw body relative to the front-side edge, the crushing operation can be effected with extremely high efficiency by virtue of the synergistic effect which is obtained from the fact that the crushing load acts in a concentrated manner and that the crushing blade is difficult to slip at the concentrated portion. Thus, the crushing machine in accordance with the present invention offers various advantages in that it is suitable for crushing a particularly hard concrete structural member or the like and that its structure is very simple.

Further, in accordance with a second aspect of the present invention, there is provided a crushing machine comprising: a crushing machine outer casing; and a pair of movable jaw bodies provided movably on the crushing machine outer casing to effect an opening and closing operation in cooperation with each other; wherein a crushing blade formed substantially in a shape of a semicircular cutting blade is provided at a distal end of each of the movable jaw bodies, the crushing blade including a rear-side edge which is formed in a substantially right-angled shape with a small arcuate edge portion located at an angled portion thereof and a front-side edge which as a whole is generally formed by a large arcuate edge portion, the rear-side edge being located at a position closer to a longitudinally inward direction side of the movable jaw body relative to the front-side edge.

In accordance with the above-described second aspect of the present invention, since the two movable jaw bodies are adapted to move and the crushing blades also move in conjunction with the movement of the movable jaw bodies, the concrete structural member or the like can be crushed from both sides, thereby making it possible to enhance the crushing efficiency by increasing the crushing force. Hence, the crushing machine in accordance with this aspect of the present invention is suitable for crushing a relatively large concrete structural member or the like.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the preferred embodiments of the present invention.

Figure 1:
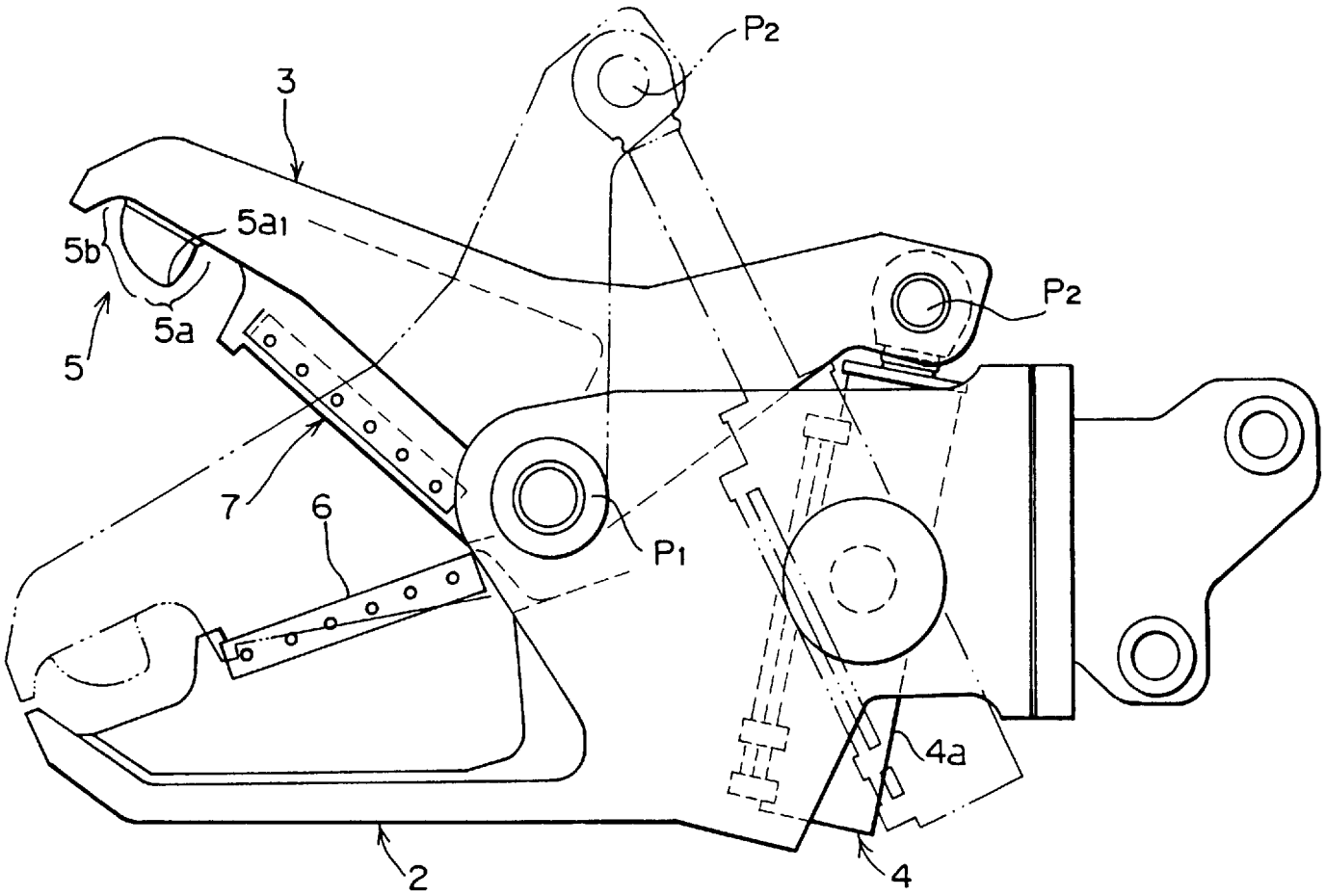
FIG. 1 is a side elevational view of a crushing machine in accordance with the present invention.
Figure 2:
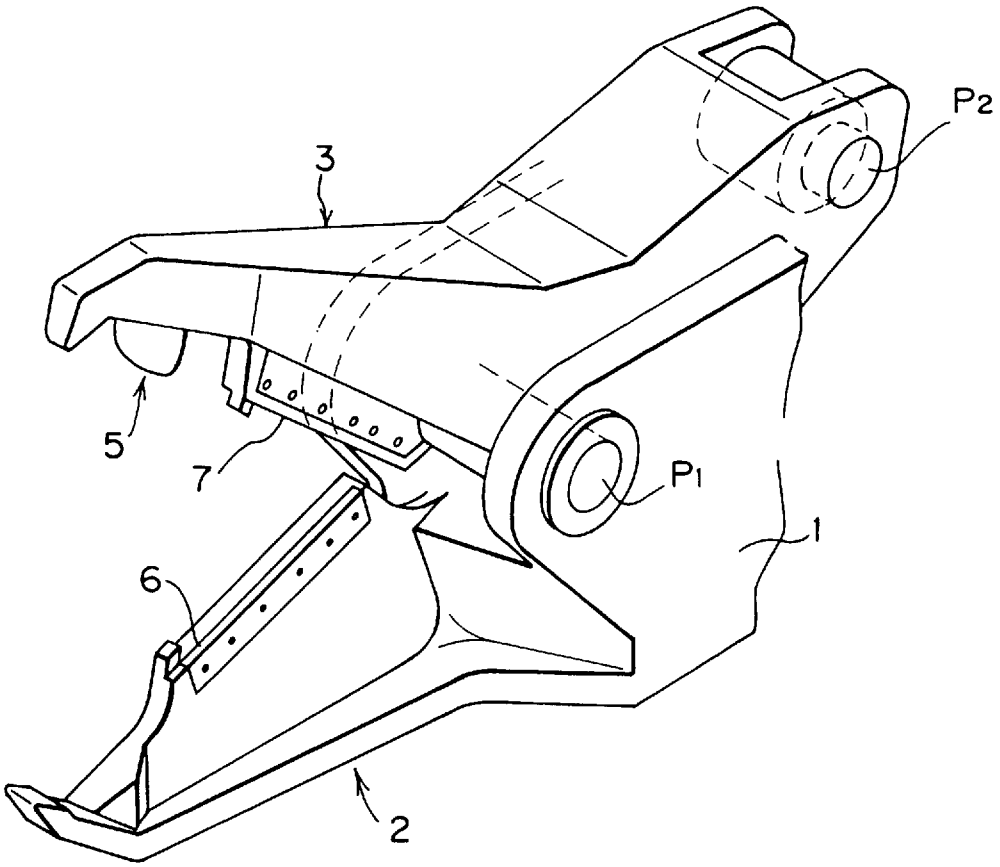
FIG. 2 is a perspective view of the crushing machine in accordance with the present invention.

As shown in FIGS. 1 and 2, the crushing machine is mainly comprised of a crushing machine outer casing 1, a fixed jaw body 2, and a movable jaw body 3. The fixed jaw body 2 is provided fixedly on the crushing machine outer casing 1, and the movable jaw body 3 which is provided movably on the crushing machine outer casing 1 effects an opening and closing operation in cooperation with the fixed jaw body 2. The movable jaw body 3 is pivotally supported at its substantially intermediate portion by the crushing machine outer casing 1, and this pivotally supporting portion will be referred to as a pivotally supporting portion $P_1$. Here, the sides of the fixed jaw body 2 and the movable jaw body 3 which face each other in the opening and closing direction will be referred to as working surface sides of the fixed jaw body 2 and the movable jaw body 3, while the sides thereof which are opposite to the working surface sides will be referred to as outer sides of the fixed jaw body 2 and the movable jaw body 3. Further, the longitudinal directions of the fixed jaw body 2 and the movable jaw body 3 which are referred to herein are those in which the fixed jaw body 2 and the movable jaw body 3 project outwardly of the crushing machine outer casing 1, and the widthwise direction is a direction which is perpendicular to the longitudinal direction.

The fixed jaw body 2 and the movable jaw body 3 are formed with hollow interiors. As shown in FIG. 1, the movable jaw body 3 is movably operated by a cylinder 4 which is mounted inside the crushing machine outer casing 1. The cylinder 4 is arranged such that a cylinder tube 4*a* is provided in such a manner as to be rotatable in a vertical plane within the crushing machine outer casing 1, and a distal end of a piston rod 4*b* is pivotally supported at an end of the movable jaw body 3 which is opposite to the blade thereof. This pivotally supporting portion will be referred to as a pivotally supporting portion P2.

Figure 4:
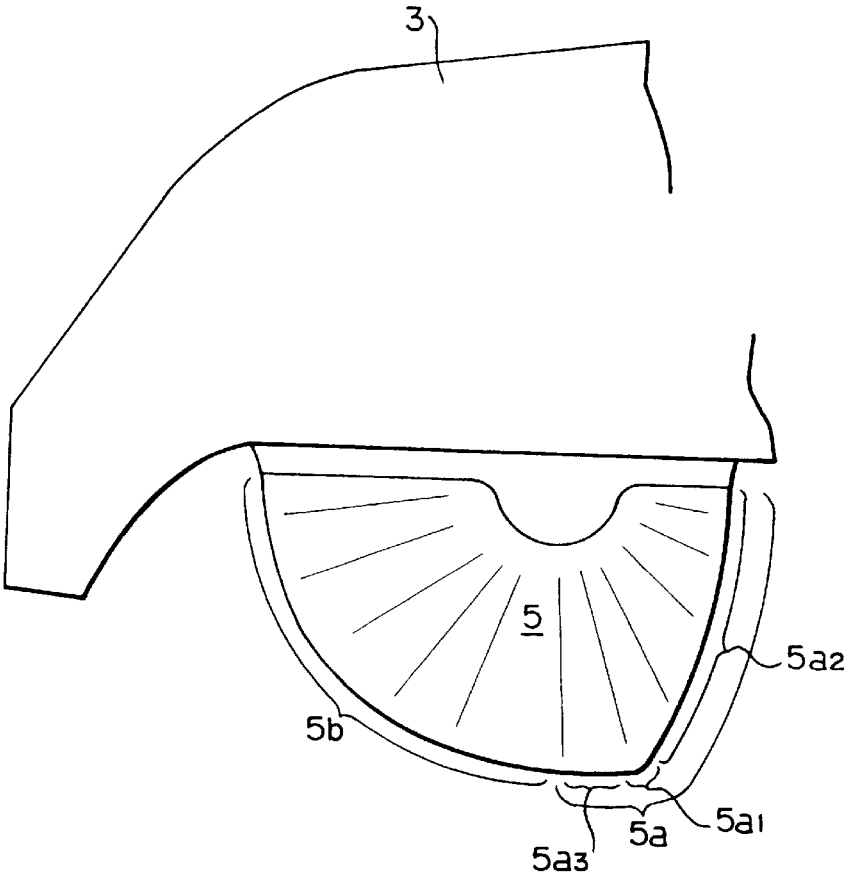
FIG. 4 is a side elevational view of a crushing blade.

As shown in FIGS. 1 and 2, a fixed jaw-side cutter 6 is provided on the working surface side of the fixed jaw body 2 in such a manner as to extend in the longitudinal direction, while a movable jaw-side cutter 7 is provided on the working surface side of the movable jaw body 3 in such a manner as to extend in the longitudinal direction. When the movable jaw body 3 is closed with respect to the fixed jaw body 2, the fixed jaw-side cutter 6 and the movable jaw-side cutter 7 relatively move in the manner of a pair of scissors in conjunction with the movement of the movable jaw body 3, thereby making it possible to cut the member to be cut by shearing (see FIGS. 1 and 4).

Figure 3:
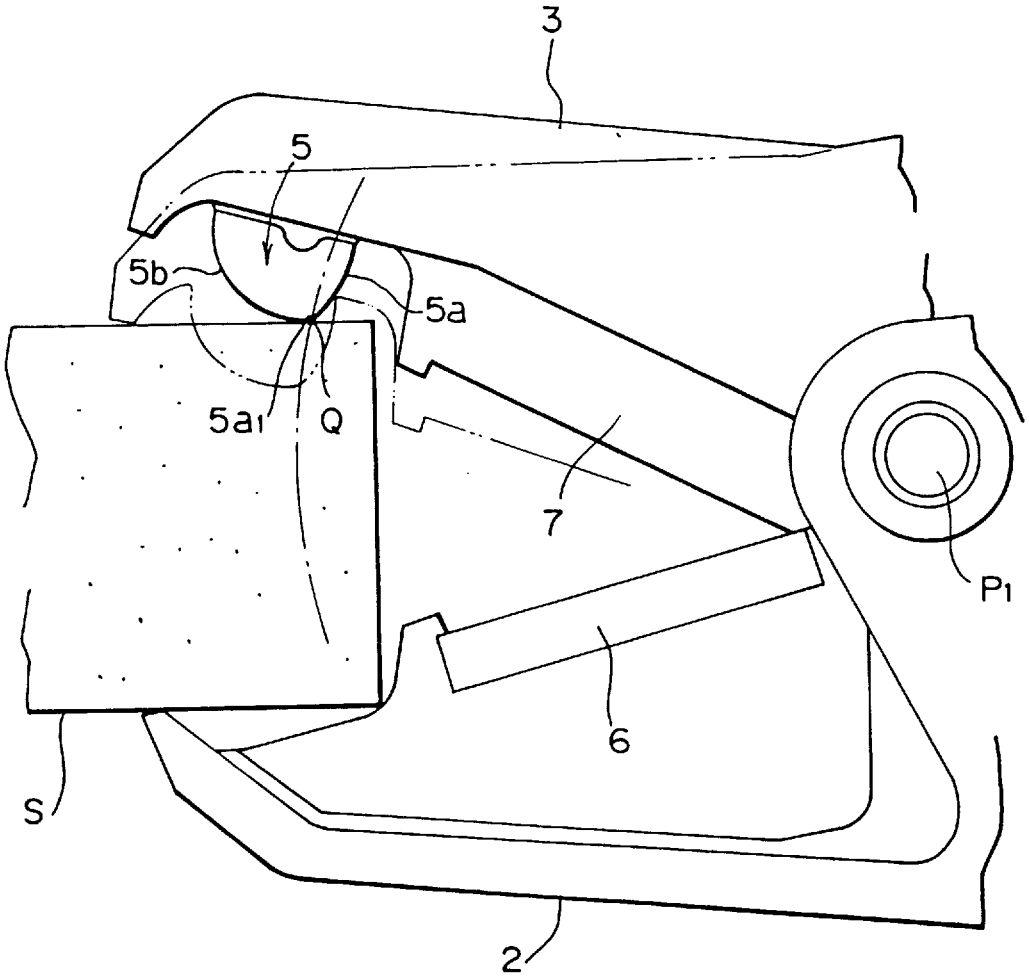
FIG. 3 is a side elevational view of essential portions and illustrate a state in which a concrete structural member is clamped by a fixed jaw body and a movable jaw body.
Figure 5:
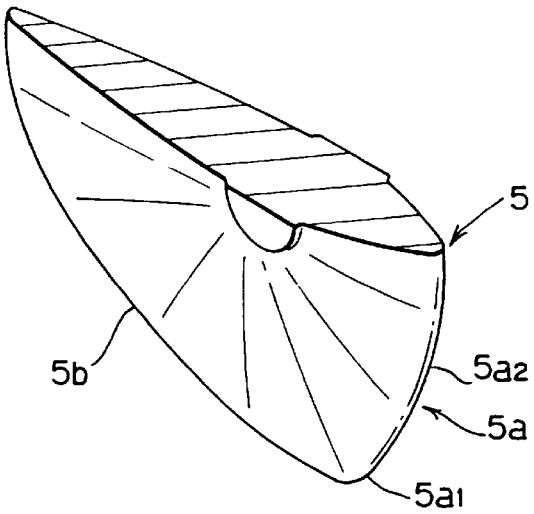
FIG. 5 is a perspective view, partly in section, of the crushing blade.

As shown in FIGS. 1,2, and 3, a crushing blade 5 is attached to the movable jaw body 3. The crushing blade 5 is formed substantially in the shape of a half-split bead of a soroban, and is gradually tapered toward its edge (see FIGS. 4 and 5). The crushing blade 5 has a streamlined shape in which its transverse dimension is largest at a position slightly offset toward the rear side from a longitudinal center thereof (see FIG. 5). A portion of the crushing blade 5 which is located on the rear side as viewed in a side view will be referred to as a rear-side edge 5*a*, while a portion of the crushing blade 5 which is located on the front side will be referred to as a front-side edge 5*b*. The rear-side edge 5*a*, as viewed in a side view, is formed in a substantially right-angled shape with a small arcuate edge portion $5a_1$ located at an angled portion thereof (see FIG. 4).

The small arcuate edge portion $5a_1$ constitutes the angled portion as a portion of the substantially right-angled rear-side edge 5*a*, but its radius of curvature is very small in terms of the overall crushing blade 5. In addition, the right-angled rear-side edge 5*a*, when seen in a side view, is seen in a state of a substantially right angle. The state of a substantially right angle includes, in addition to the state of a right angle, the state of an angle close to the right angle such as an obtuse angle or an acute angle. The right-angled rear-side edge 5*a* is constituted by the small arcuate edge portion $5a_1$ as well as a rear-end edge portion $5a_2$ and a front-end edge portion $5a_3$. The rear-end edge portion $5a_2$ and the front-end edge portion $5a_3$ are formed continuously via the small arcuate edge portion $5a_1$, while the front side of the front-end edge portion $5a_3$ is formed continuously with the front-side edge 5*b*.

The crushing blade 5 is mounted on the movable jaw body 3 such that the rear-side edge 5*a* of the crushing blade 5 is located at a position closer to a longitudinally inward direction side of the movable jaw body 3 relative to the front-side edge 5*b* of the crushing blade 5. In this specification and in the appended claims, the longitudinally inward direction side of the movable jaw body 3 refers to a side thereof which is closer to the aforementioned pivotally supporting portion $P_1$. That is, the rear-side edge 5*a* of the crushing blade 5 is located at a position closer to the pivotally supporting portion $P_1$. The shape of the front-side edge 5*b* of the crushing blade 5 as a whole is generally formed by a large arcuate edge portion, and is specifically formed substantially in the shape of one fourth of a circle. The front-side edge 5*b* is formed continuously from the rear-side edge 5*a*.

Figure 10:
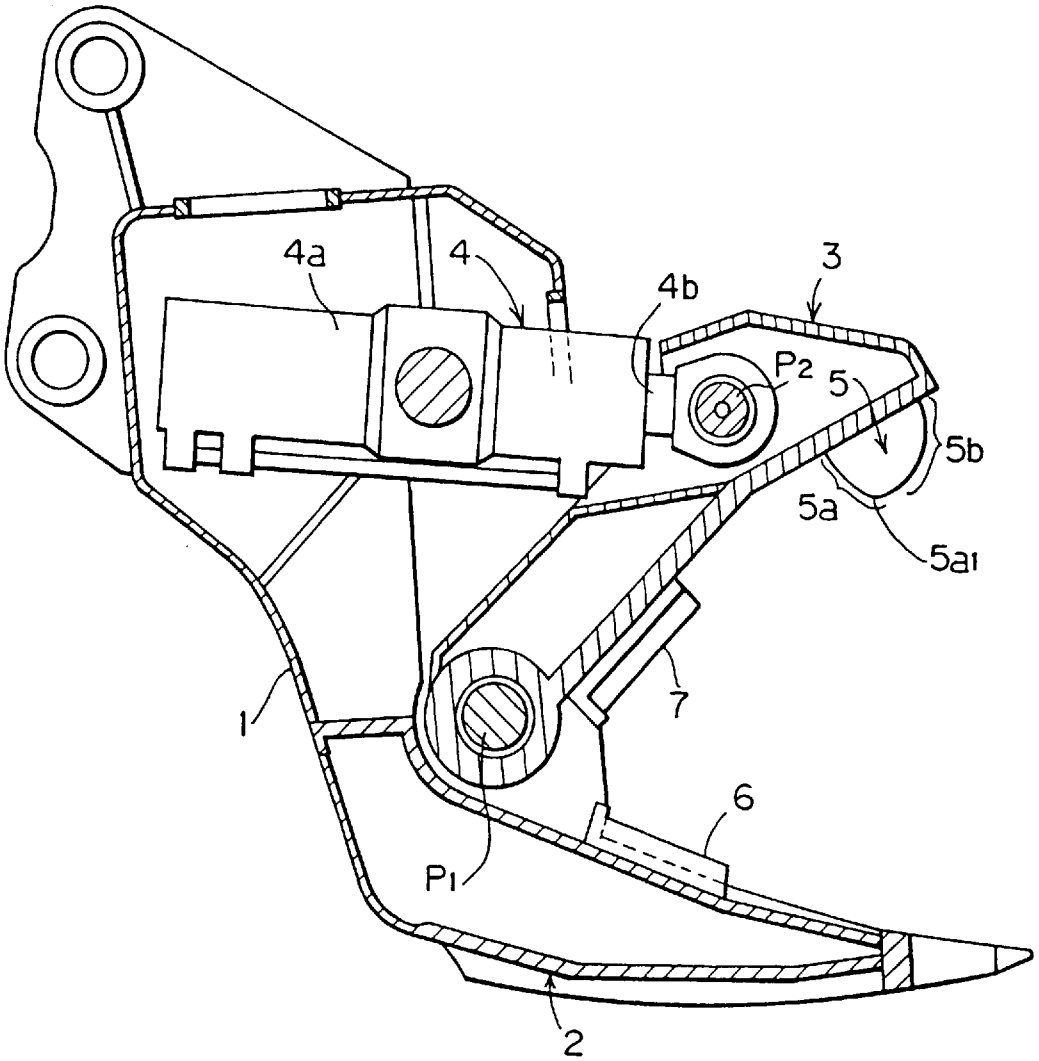
FIG. 10 is a vertical longitudinal sectional view illustrating a second embodiment of the present invention.
Figure 11:
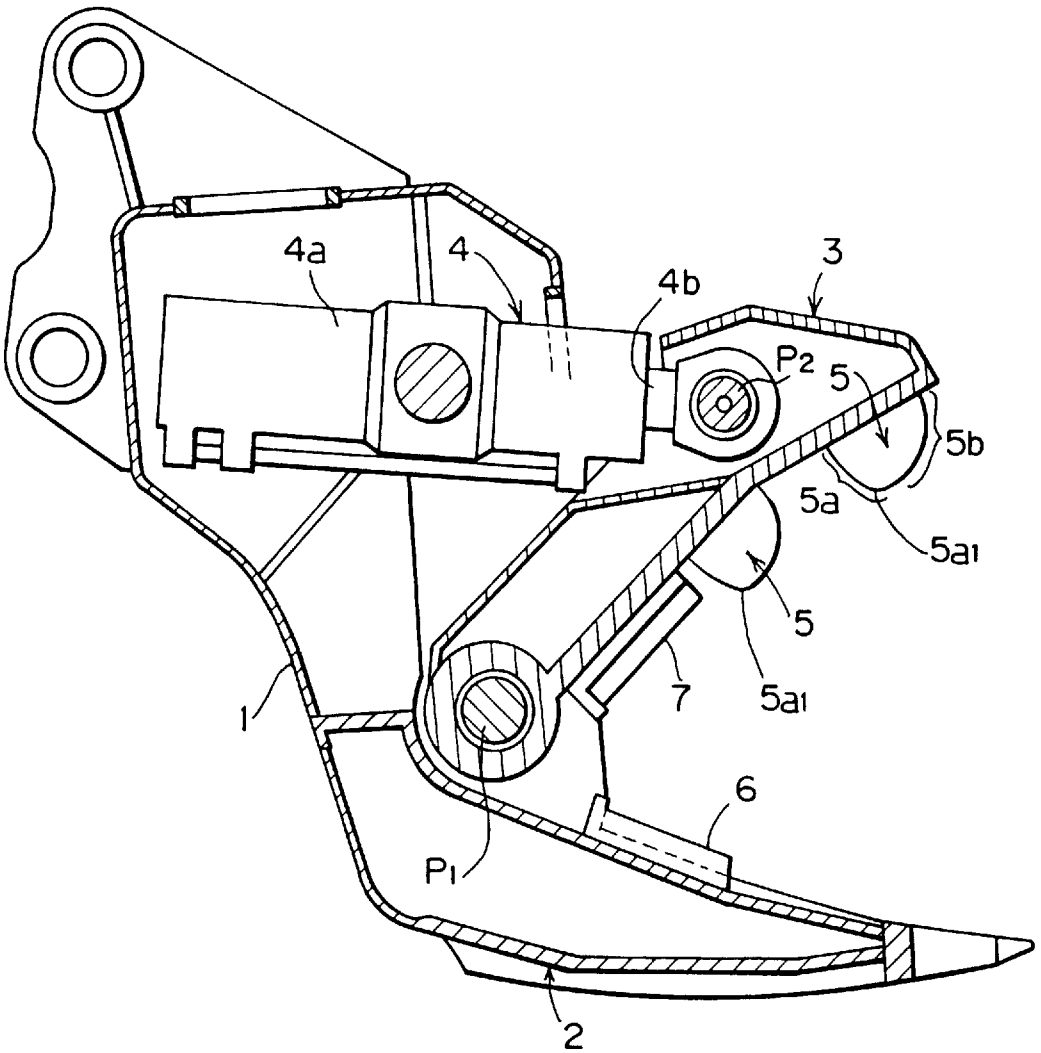
FIG. 11 is a vertical longitudinal sectional view illustrating a modification of the second embodiment of the present invention.
Figure 12:
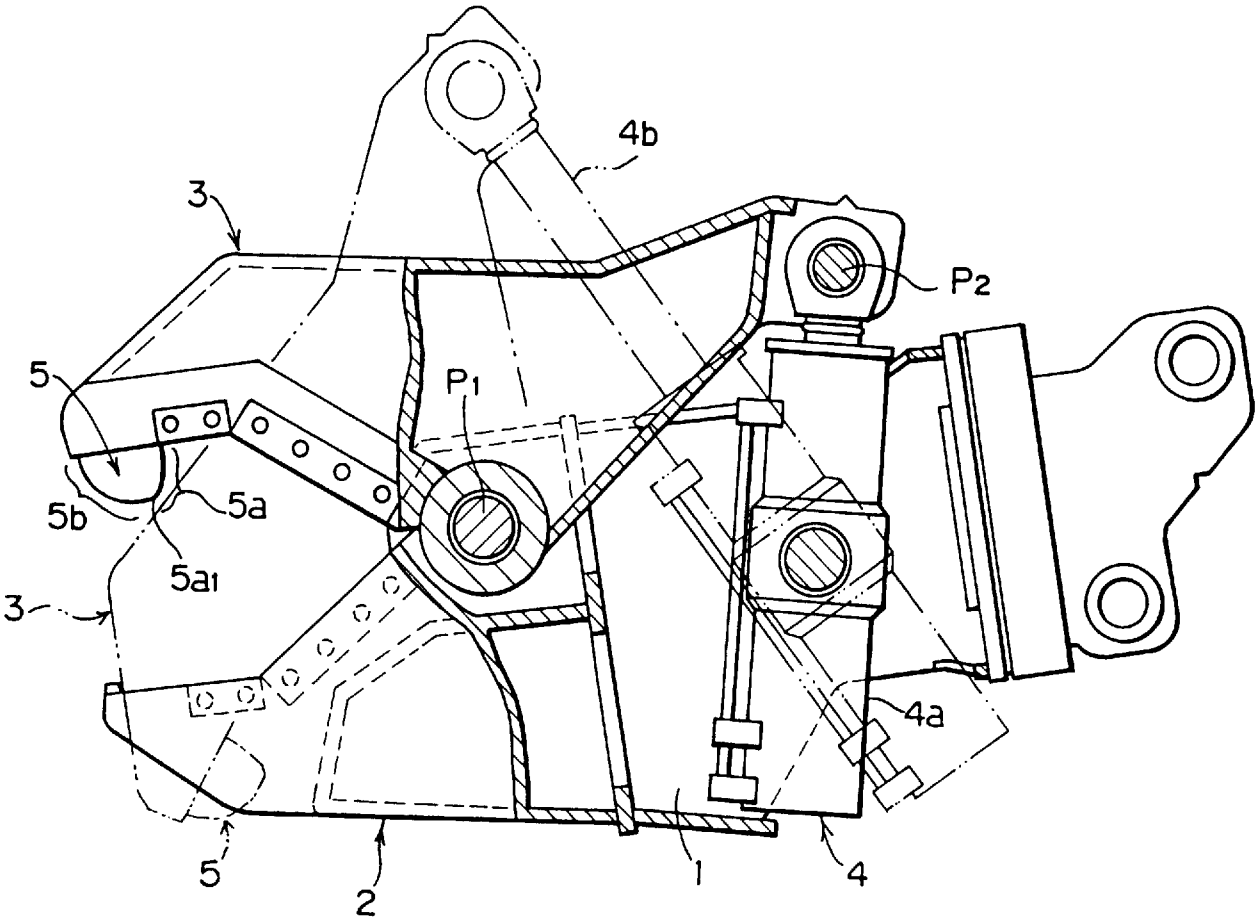
FIG. 12 is a vertical longitudinal sectional view illustrating a third embodiment of the present invention.
Figure 13:
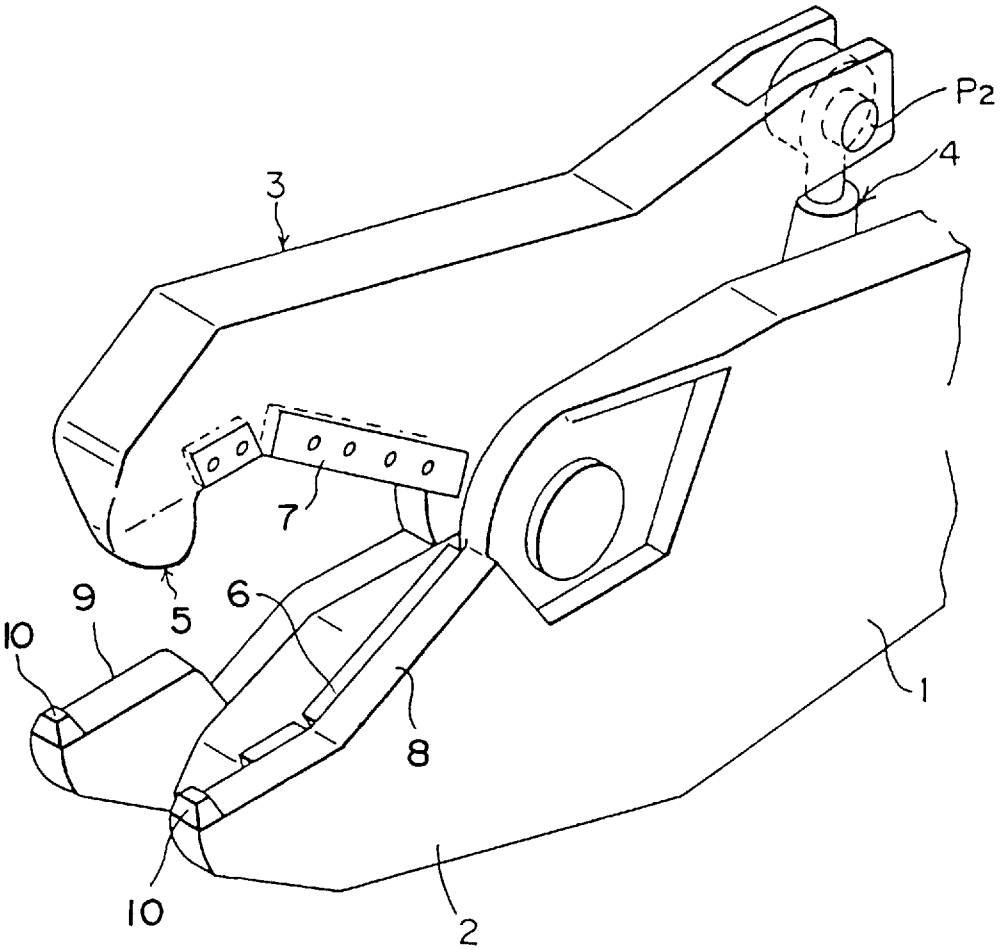
FIG. 13 is a perspective view of essential portions illustrating the third embodiment of the present invention.

FIG. 10 shows a crushing machine in accordance with a second embodiment of the present invention, which is of a type primarily aimed at crushing a concrete structural member S with a greater crushing force by means of the fixed jaw body 2 and the movable jaw body 3. In the second embodiment, the distal end of the piston rod 4*b* of the cylinder 4 is pivotally supported at a distal end portion of the movable jaw body 3 which is close to the crushing blade 5, so as to increase the crushing force. FIG. 11 shows a modification of the second embodiment, in which two crushing blades 5 are arranged on the movable jaw body 3 in the longitudinal direction thereof. FIGS. 12 and 13 show a third embodiment of the present invention. In terms of its specific structure, the crushing machine in accordance with the third embodiment is arranged such that a rising portion 8 on which the fixed jaw-side cutter 6 is fitted along the longitudinal direction of the fixed jaw body 2 is formed on one end side in the widthwise direction of the fixed jaw body 2. Additionally, a distal-end rising portion 9 is formed at a distal end of the fixed jaw body 2 on a widthwise opposite side thereof. A pair of fixed jaw-side projections 10 are provided at distal ends of the rising portion 8 and the distal-end rising portion 9, and the crushing blade 5 is provided at a distal end of the movable jaw body 3. The arrangement provided is such that the crushing blade 5 passes a transversely intermediate portion of the fixed jaw body 2 between the rising portion 8 and the distal-end rising portion 9, and the shearing operation is effected by the fixed jaw-side cutter 6 and the movable jaw-side cutter 7.

Figure 14:
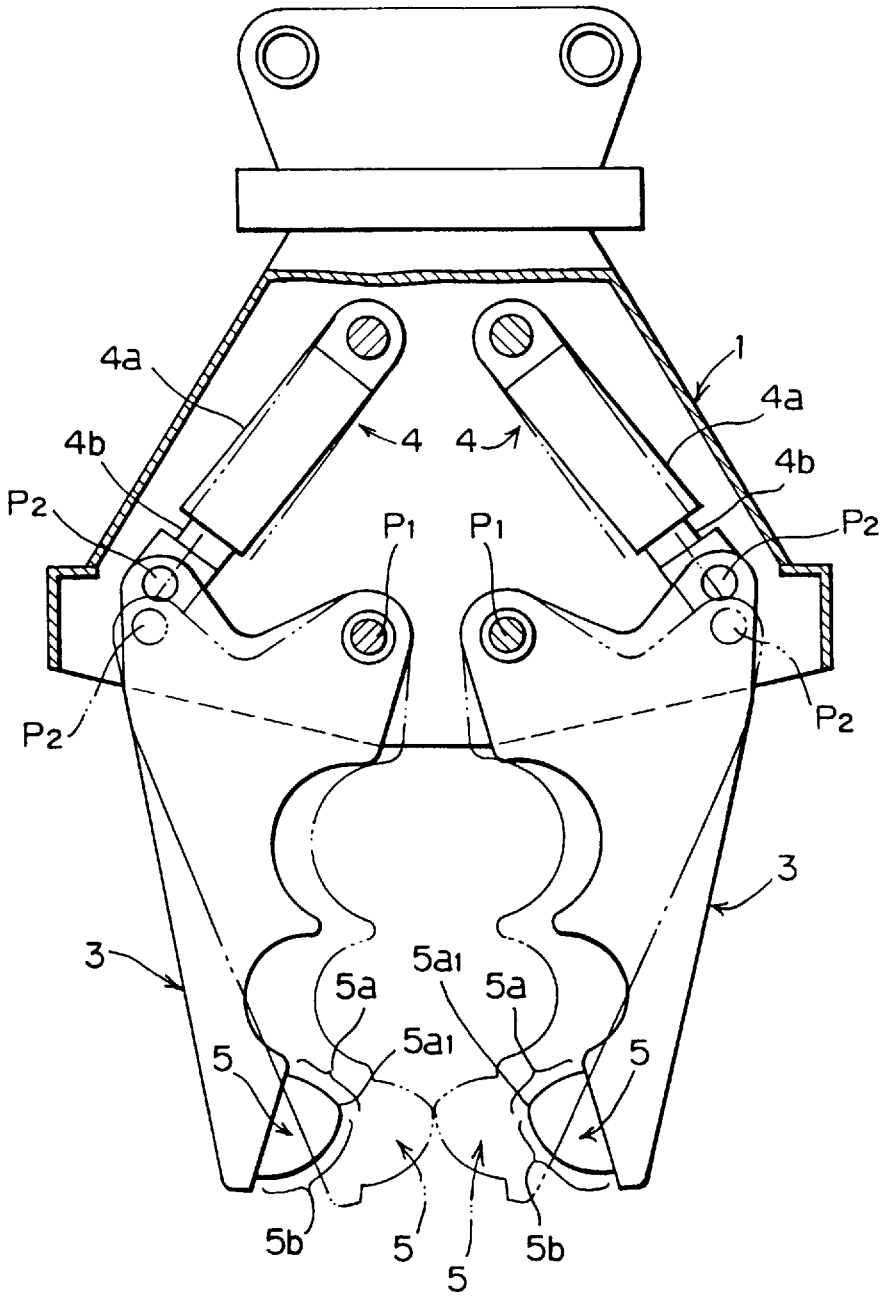
FIG. 14 is a vertical longitudinal sectional view illustrating a fourth embodiment of the present invention.
Figure 15:
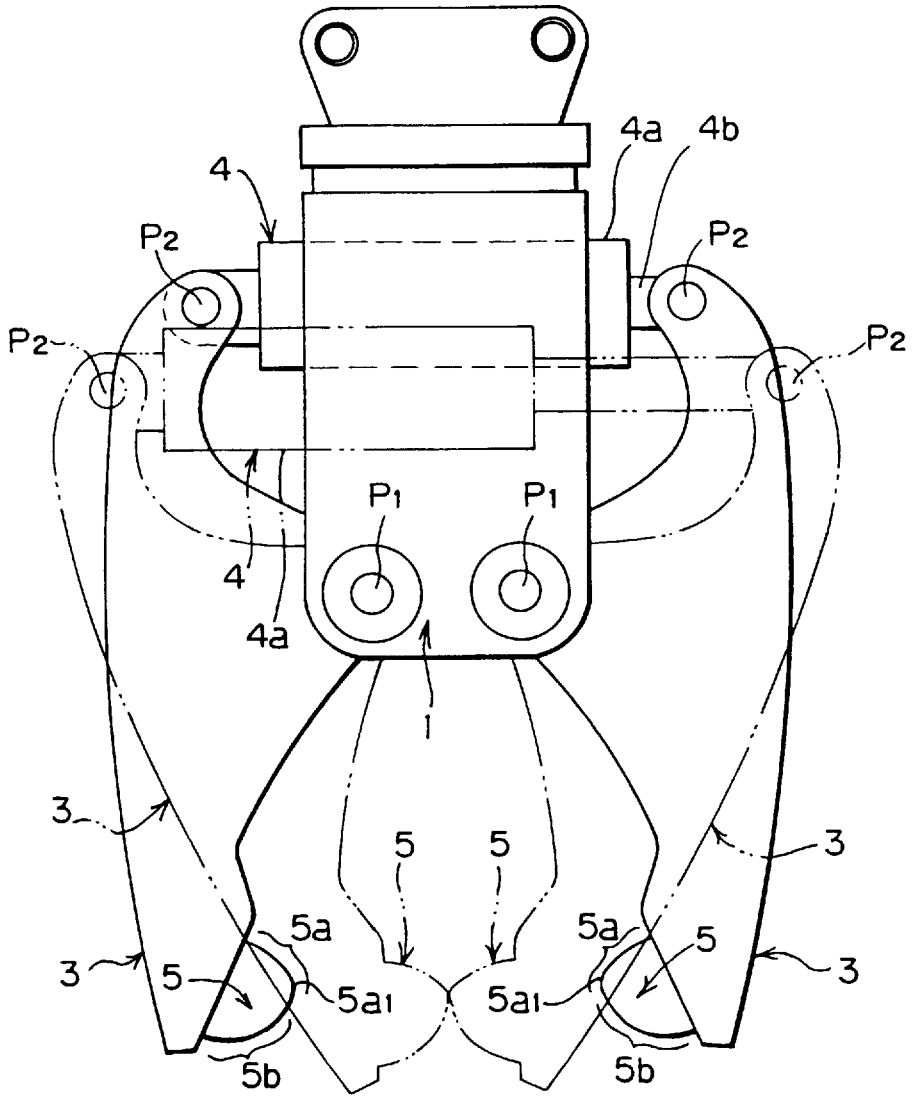
FIG. 15 is a vertical longitudinal sectional view illustrating a modification of the fourth embodiment of the present invention.

FIG. 14 shows a fourth embodiment of the present invention. The crushing machine in accordance with the fourth embodiment is comprised of a pair of movable jaw bodies 3 unlike the type which is comprised of the fixed jaw body 2 and the movable jaw body 3 as shown in the first to third embodiments of the present invention, i.e., the fixed jaw body 2 is not present in the fourth embodiment. The two movable jaw bodies 3 are moved by two cylinders 4 which are accommodated in the crushing machine outer casing 1. Two arcuate recesses are formed in a longitudinally intermediate portion of each of the movable jaw bodies 3. FIG. 15 shows a modification of the fourth embodiment which adopts a structure in which the two movable jaw bodies 3 are moved by a single cylinder 4. Namely, the pivotally supporting portion $P_2$ of one movable jaw body 3 constitutes a connecting portion for connecting that movable jaw body 3 and an axial end of the cylinder tube 4*a* of the cylinder 4, and the pivotally supporting portion $P_2$ of the other movable jaw body 3 constitutes a connecting portion for connecting that movable jaw body 3 and a distal end of the piston rod 4*b* of the cylinder 4.

In an example of the first embodiment of the present invention, the interval from the small arcuate edge portion $5a_1$ of the crushing blade 5 to the distal end of the fixed jaw body 2 in a state in which the fixed jaw body 2 and the movable jaw body 3 were opened to a maximum degree was set to 870 mm. In addition, the inside diameter of the tube of the cylinder 4 was 180 mm, and the stroke was 55 mm. As a specimen of a crushing test, reinforced concrete pillars of a 800 mm×800 mm square were used. In the case of a conventional type of crushing machine (see FIG. 16), when the reinforced concrete pillar is crushed, slippage initially occurs between the crushing blade and the surface of the reinforced concrete pillar. Then, after the slippage has progressed appropriately, the crushing blade bites into the surface of the reinforced concrete pillar and effects the crushing operation.

In the present invention, slippage between the crushing blade 5 and the reinforced concrete pillar initially occurred by only 2 mm or thereabouts, and the crushing blade 5 bit into the reinforced concrete pillar immediately afterwards, and cracks occurred when the depth of the bite reached about 8 mm to 12 mm. The crushing pressure at that time was 228 kgf/cm2. In this crushing test of the present invention, it was possible to obtain an energy-saving effect of about 40% in the crushing force as compared with the conventional type.

Figure 6:
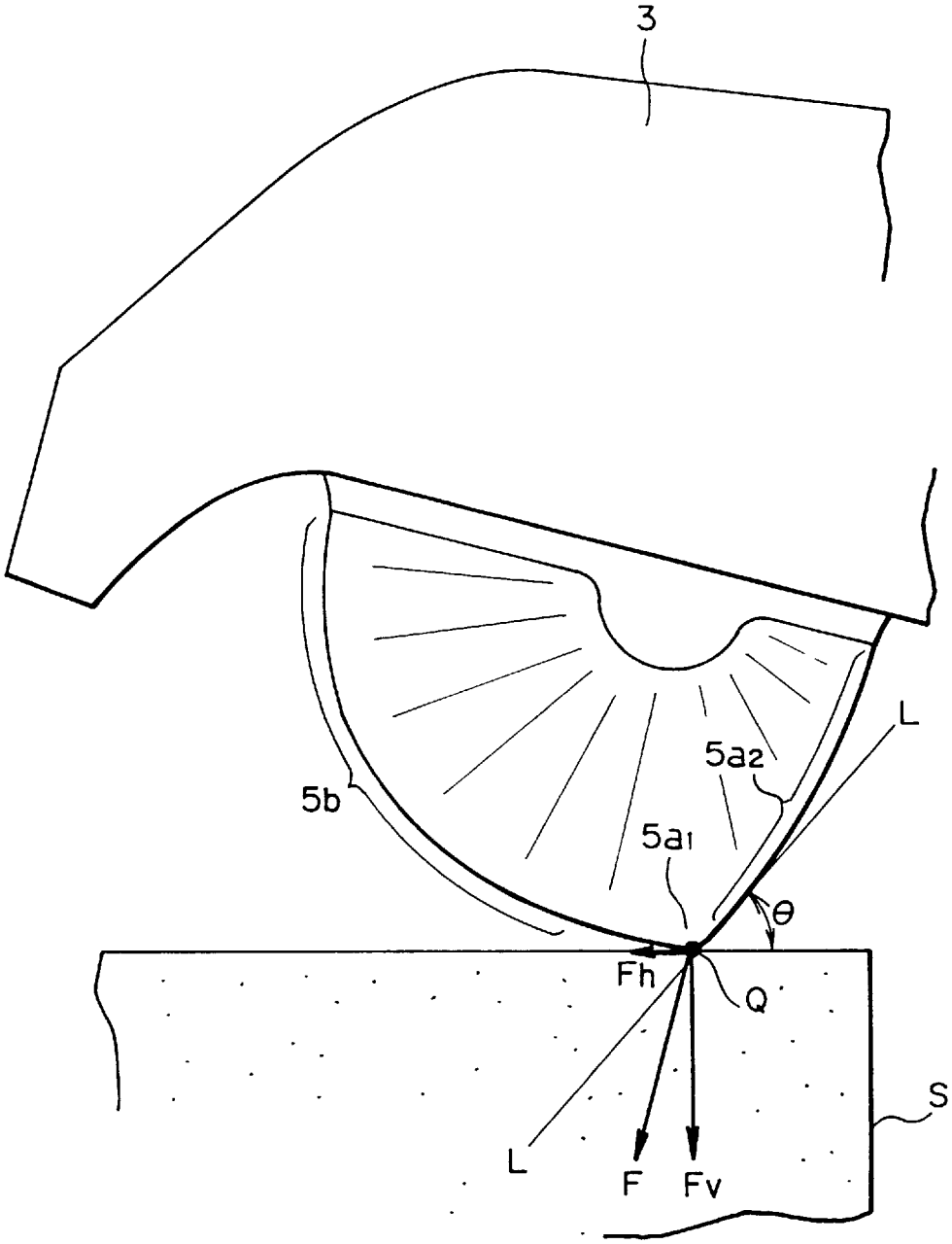
FIG. 6 is an enlarged side elevational view illustrating the crushing action of the crushing blade.
Figure 16:
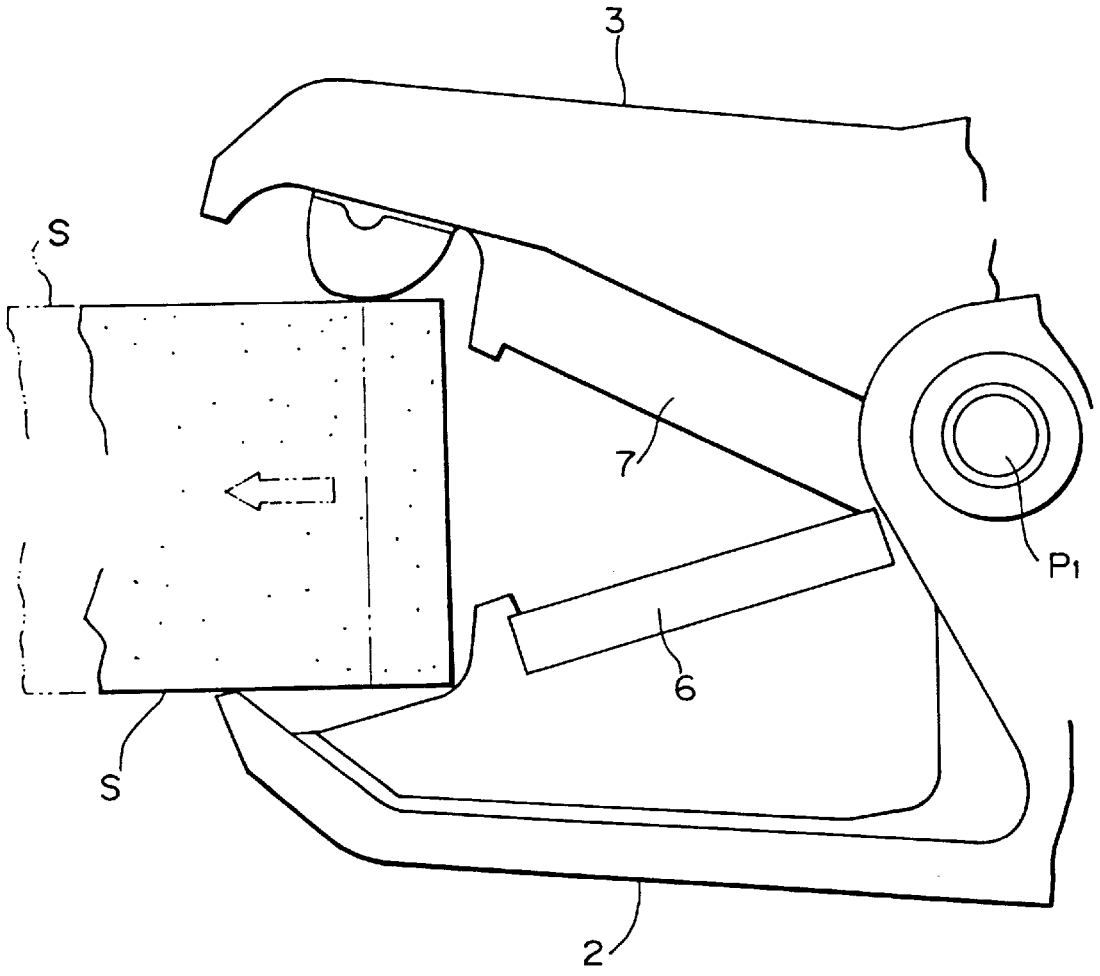
Fig. 16 PRIOR ART
FIG. 16 is a side elevational view of a conventional crushing machine.
Figure 17:
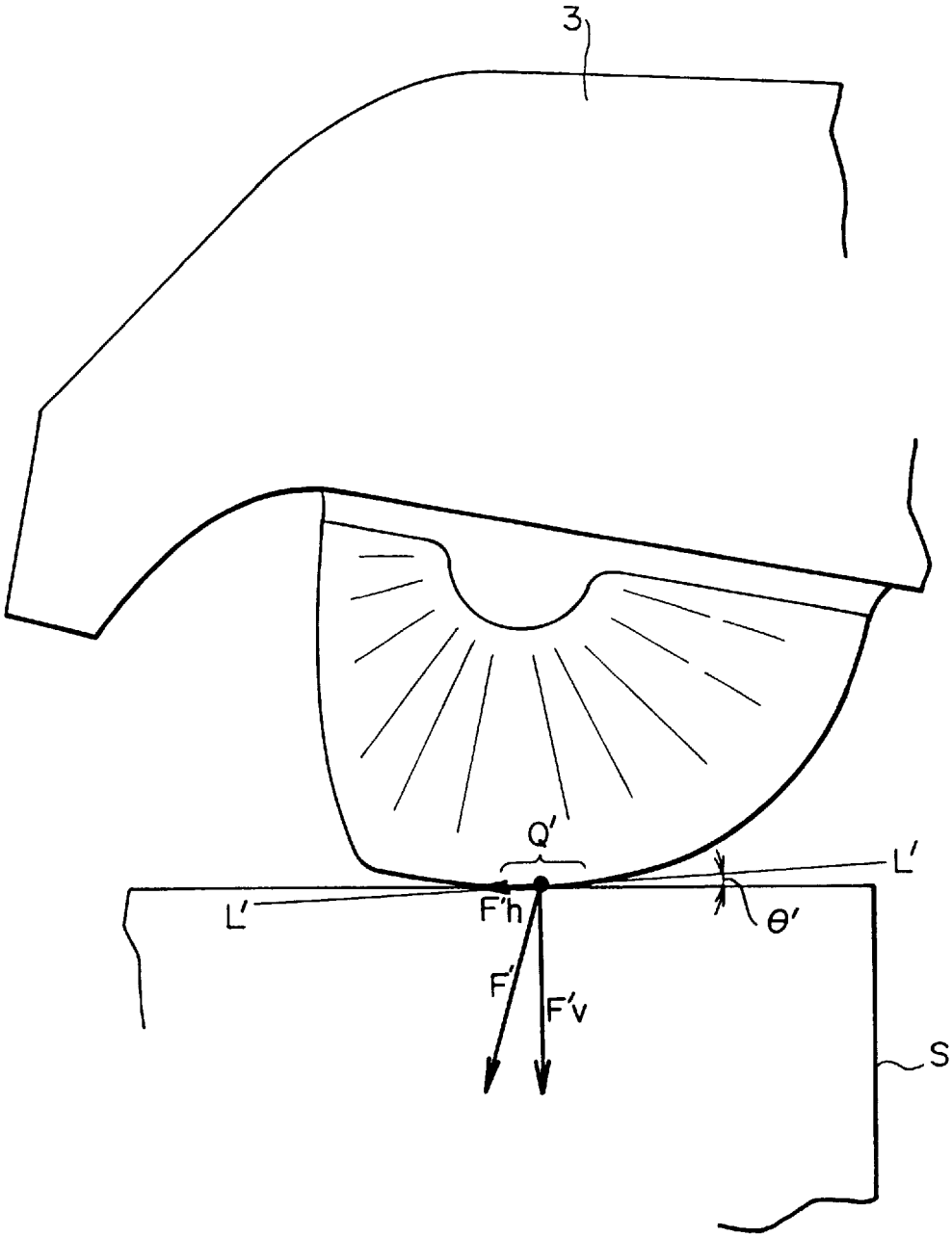
Fig. 17 PRIOR ART
FIG. 17 is a side elevational view illustrating a state of action in accordance with the conventional crushing machine.

A description will be given of the state of a force which is exerted by the crushing blade 5 upon the concrete structural member S when the concrete structural member S is crushed in accordance with the present invention. FIG. 6 shows the action of the crushing blade 5 in accordance with the present invention. In contrast, FIGS. 16 and 17 show the action of the conventional-type crushing blade formed substantially in the shape of a half-split bead of a soroban.

First, the concrete structural member S, which is produced as a result of demolishing a structure, is clamped by the fixed jaw body 2 and the movable jaw body 3 by causing the movable jaw body 3 to approach the fixed jaw body 2 until the crushing blade 6 is brought into contact with the surface of the concrete structural member S (see FIG. 3).

At this time, as for the crushing blade 5, its small arcuate edge portion $5a_1$ or its vicinity is brought into contact with the surface of the concrete structural member S. The point where the small arcuate edge portion $5a_1$ of the crushing blade 5 is first brought into contact with the surface of the concrete structural member S will be referred to as a contact portion Q (see FIG. 6). Here, when the concrete structural member S is crushed, the range of the small arcuate edge portion $5a_1$ is first brought into contact with the concrete structural member S.

The contact portion Q is located in the range of the small arcuate edge portion $5a_1$, and the state of contact of the contact portion Q at the small arcuate edge portion $5a_1$ with respect to the surface of the concrete structural member S is a state of point contact (including a state of virtual point contact) (see FIG. 6). Accordingly, in an initial stage of contact of the crushing blade 5 with respect to the concrete structural member S, a crushing load F is a concentrated load at the contact portion Q of the small arcuate edge portion $5a_1$. Namely, since the crushing load F is concentrated substantially at a single location at the contact portion Q of the small arcuate edge portion $5a_1$ without becoming dispersed, the crushing blade 5 is able to bite into even a concrete structural member S having a hard surface by using the contact portion Q as a center of penetration (see FIG. 7).

In contrast, in the case of the crushing machine equipped with the conventional-type crushing blade formed substantially in the shape of a half-split bead of a soroban, as shown in FIGS. 16 and 17, since the edge portion on the rear edge side of the crushing blade is an arcuate blade portion, clearly it cannot be said that a contact portion Q' with respect to the concrete structural member S is in the state of point contact. This portion is in a state of line contact over a relatively large range. Accordingly, a crushing load F' is in a state of distributed load due to the line contact at the contact portion Q', and the crushing load F' is dispersed. Thus, the conventional crushing machine is quite disadvantageous in crushing the concrete structural member S having a particularly hard surface.

Next, to illustrate the ease with which the crushing blade 5 is able to bite into the concrete structural member S in the present invention, an imaginary tangential line L—L is assumed at the rear-side edge 5*a* on the rear edge side (on the rear-end edge portion $5a_2$ side) of the contact portion Q of the small arcuate edge portion $5a_1$. The operating efficiency at the time of biting is illustrated by an angle which is formed by the aforementioned imaginary tangential line L—L and the surface of the concrete structural member S when the rear-side edge 5*a* of the crushing blade 5 bites into the interior from the surface of the concrete structural member S. Namely, in FIG. 6, an angle θ which is formed by the aforementioned imaginary tangential line L—L and the surface of the concrete structural member S is large. This means that the angle at which the rear-side edge 5*a* of the crushing blade 5 bites into the concrete structural member S is large, so that the load-concentrated portion which is at the small arcuate edge portion $5a_1$ becomes difficult to slip, thereby allowing a satisfactory bite into the concrete structural member S.

Figure 7:
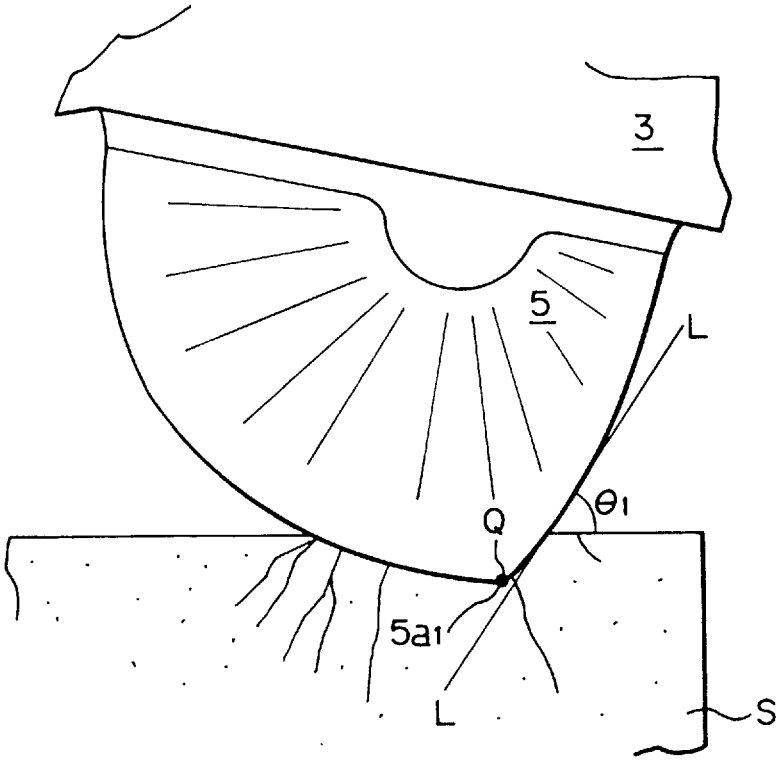
FIG. 7 is a side elevational view of essential portions and illustrate a state in which the crushing blade has slightly bitten into the concrete structural member.

Further, the more the crushing blade 5 bites into the concrete structural member S, the angle θ formed by the imaginary tangential line L—L and the surface of the concrete structural member S at the exposed portion of the rear-side edge 5*a* with respect to the surface of the concrete structural member S becomes gradually larger, and the crushing blade 5 is therefore difficult to slip, making it possible to effect crushing with a concentrated load. Namely, FIG. 6 shows a state in which the concrete structural member is yet to be bitten into and the contact portion Q abuts against the surface of the concrete structural member S. FIG. 7 shows a state in which the crushing blade 5 has bitten into the concrete structural member S from its surface to a certain depth, and the angle θ formed by the tangential line L—L and the surface of the concrete structural member S at the rear-side edge 5*a* of the crushing blade 5 becomes closer to a right angle, so that $\theta_1>\theta$. This means that the more the crushing blade 5 bites into the concrete structural member S, the larger the biting angle of the rear-side edge 5*a* becomes, and the crushing blade 5 is difficult to slip, making it possible to effect crushing with a concentrated load. Thus, the crushing operation can be facilitated.

In contrast, in the case of the crushing machine equipped with the conventional-type crushing blade formed substantially in the shape of a half-split bead of a soroban,as shown in FIG. 17, the angle θ' formed by the line L'—L' tangential to the contact portion Q' on the rear edge side of the crushing blade and the surface of the concrete structural member S becomes relatively small at several degrees. That is, the angle at which the concrete structural member S is bitten into becomes small, and the crushing blade is liable to slip forward by that margin when the concrete structural member S is crushed. In addition, the load at the cross-sectional area of crushing by the crushing blade 5 is a distributed load, so that a large force is required. For this reason, the crushing machine of this type is disadvantageous in crushing the concrete structural member S having a particularly hard surface.

Thus, in the present invention, since the contact portion Q of the crushing blade 5 is in point contact, the crushing machine does not effect crushing over a large range instantaneously. However, particularly in crushing a hard concrete structural member S, the crushing load F is concentrated at the contact portion Q in the initial stage of crushing since the contact portion Q is in point contact, thereby allowing the crushing of the hard concrete structural member S to be effected.

Figure 8:
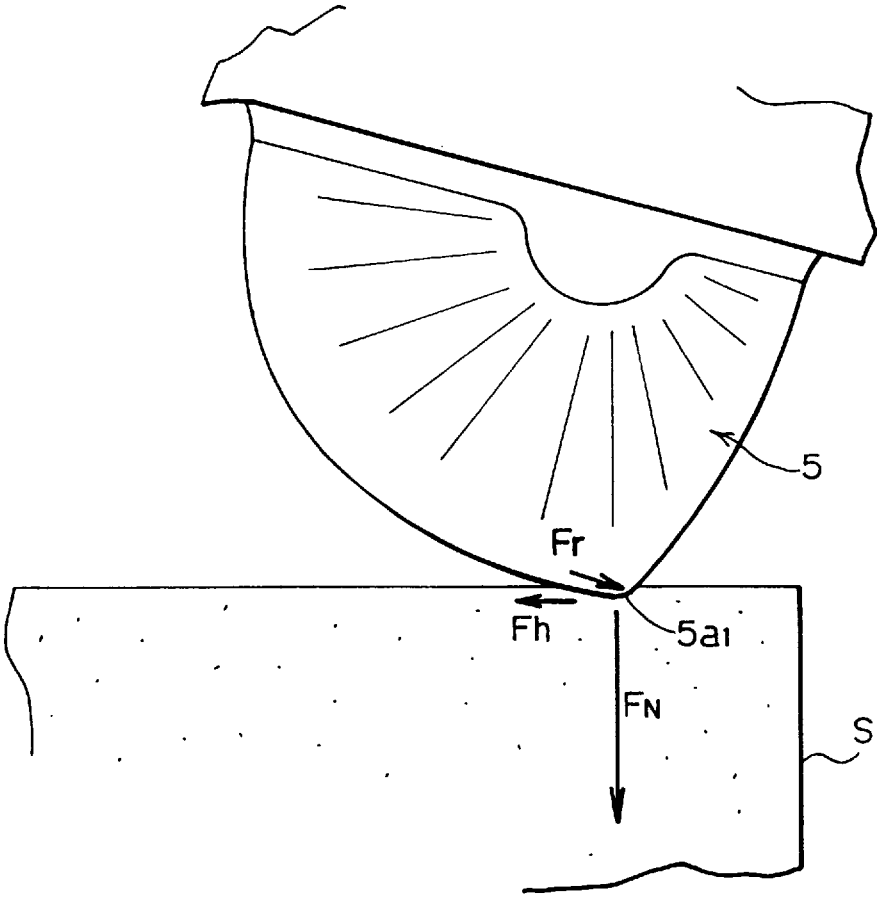
FIG. 8 is a side elevational view of the essential portions and illustrate the fact that the crushing blade is difficult to slip on the concrete structural member when the concrete structural member is crushed by the crushing blade.
Figure 9:
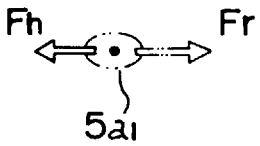
FIG. 9 is a diagram of acting forces and illustrates the fact that the crushing blade is difficult to slip on the concrete structural member when the concrete structural member is crushed by the crushing blade.

A more detailed description will be given of the theory of crushing due to slippage from another perspective. When the concrete structural member S is crushed by the conventional crushing machine, a horizontal component of the crushing force causes slippage between the movable jaw and the concrete structural member S, with the result that the crushing efficiency is possibly lowered. In contrast, although the crushing blade 5 in the present invention also produces a horizontal component Fh and a vertical component Fv in terms of the crushing load F with respect to the surface of the surface of the concrete structural member S when crushing the concrete structural member S, the vertical component Fv, serves as a crushing force, while the horizontal component Fh serves as a force for allowing the concrete structural member S to escape in the horizontal direction.However, since the contact portion Q of the small arcuate edge portion $5a_1$ of the crushing blade 5 slightly bites into the surface of the concrete structural member S by the concentrated vertical component Fv substantially at the same time as the horizontal component Fh acts (see FIG. 8), resistance Fr which opposes the horizontal component Fh acts at the small arcuate edge portion $5a_1$ at the bitten portion. Hence, it is possible to prevent the escape of the concrete structural member S when the concrete structural member S is crushed (see FIG. 9).

As described above, the crushing machine in accordance with the first to third embodiments of the present invention includes: the crushing machine outer casing 1; the fixed jaw body 2 provided fixedly on the crushing machine outer casing 1; and the movable jaw body 3 provided movably on the crushing machine outer casing 1 to effect an opening and closing operation in cooperation with the fixed jaw body 2. The crushing blade 5 formed substantially in the shape of a semicircular cutting blade is provided at a distal end of the movable jaw body 3, the crushing blade 5 including the rear-side edge 5*a* which is formed in a substantially right-angled shape with the small arcuate edge portion $5a_1$ located at an angled portion thereof and the front-side edge 5*b* which as a whole is generally formed by a large arcuate edge portion, the rear-side edge 5*a* being located at a position closer to a longitudinally inward direction side of the movable jaw body 3 relative to the front-side edge 5*b*. Accordingly, the crushing machine in accordance with the present invention offers various advantages in that, first of all, it is suitable for crushing a particularly hard concrete structural member S and that, secondly, its structure is very simple.

To give a more detailed description of these advantages, since the rear-side edge 5*a* of the crushing blade 5 is made substantially right-angled with the small arcuate edge portion $5a_1$ located at the corner, the state in which the rear-side edge 5*a* is in contact with the surface of the concrete structural member S to effect crushing is a state in which the small arcuate edge portion $5a_1$ mainly contacts the surface of the concrete structural member S. Since the small arcuate edge portion $5a_1$ has a very small radius, the state of contact of the small arcuate edge portion $5a_1$ with respect to the surface of the concrete structural member S is a state of point contact (including a state of virtual point contact). Therefore, in the initial stage of the crushing of the concrete structural member S by the crushing blade 5, it is possible to obtain a concentrated crushing load F exerted on the concrete structural member S by the contact portion of the small arcuate edge portion $5a_1$. Namely, since the crushing load F is concentrated substantially at a single location at the contact portion of the small arcuate edge portion $5a_1$ with respect to the concrete structural member S without becoming dispersed, the crushing blade 5 is able to satisfactorily bite into even a concrete structural member S having a hard surface.

Further, it is possible to enlarge the biting angle at which the contact portion of small arcuate edge portion $5a_1$ at the rear-side edge 5*a* of the crushing blade 5 bites into the concrete structural member S. In other words, the crushing blade 5 is made difficult to slip on the concrete structural member S, and reliably bites into it in the manner of a wedge. For this reason, the largest advantage lies in that the crushing operation can be effected with extremely high efficiency by virtue of the synergistic effect which is obtained from the fact that the aforementioned crushing load acts in a concentrated manner and that the crushing blade 5 is difficult to slip at the concentrated portion.

In addition, as described above, the crushing machine in accordance with the fourth embodiment of the present invention includes: the crushing machine outer casing 1; and the pair of movable jaw bodies 3 provided movably on the crushing machine outer casing 1 to effect an opening and closing operation in cooperation with each other. The crushing blade 5 formed substantially in the shape of a semicircular cutting blade is provided at a distal end of each of the movable jaw bodies 3, the crushing blade 5 including the rear-side edge 5*a* which is formed in a substantially right-angled shape with the small arcuate edge portion $5a_1$ located at an angled portion thereof and the front-side edge 5*b* which as a whole is generally formed by a large arcuate edge portion, the rear-side edge 5*a* being located at a position closer to a longitudinally inward direction side of the movable jaw body 3 relative to the front-side edge 5*b*. Accordingly, since the two movable jaw bodies 3 are adapted to move and the crushing blades 5 also move in conjunction with the movement of the movable jaw bodies 3, the concrete structural member 3 can be crushed from both sides, thereby enhancing the crushing efficiency by increasing the crushing force. Hence, the crushing machine in accordance with the present invention is suitable for crushing a relatively large concrete structural member S.

What is claimed is:

1. A crushing machine comprising:

a crushing machine outer casing;

a fixed jaw body fixedly secured to said crushing machine outer casing;

a movable jaw body pivotally secured to said crushing machine outer casing;

an actuating device mounted on said crushing machine outer casing and coupled to said movable jaw body to effect an opening and closing operation of said movable jaw body relative to said fixed jaw body; and a crushing blade having a substantially semicircular shape provided at a distal end of said movable jaw body, said crushing blade including:

a rear-side edge having a rear-end edge portion, a front-end edge portion, and a small arcuate edge portion, said rear-end edge portion and said small arcuate edge portion forming a substantially right-angled shape, said small arcuate edge portion located at an apex of said right-angled shape, and a front-side edge generally formed by a large arcuate edge portion, said crushing blade being oriented such that said rear-side edge is located at a position closer to a longitudinally inward direction side of said movable jaw body relative to said front-side edge.

2. A crushing machine according to claim 1 wherein both of said jaw bodies are secured in a pivotal manner.

3. A crushing machine according to claim 1 wherein one of said jaw bodies is angled to define an intermediate portion and wherein an additional crushing blade is positioned in said intermediate portion.

4. A crushing machine according to claim 1 wherein said at least one actuating device is coupled at a location proximate the distal end of one of said jaw bodies.

5. A crushing machine according to claim 1 wherein one of said jaw bodies is bifurcated to include a pair of distal end rising portions, each of said distal end rising portions terminating in a projection, and wherein the other one of said jaw bodies may be pivoted such that said crushing blade is inserted a predetermined distance between said pair of distal end rising portions.

6. A crushing machine comprising:

a crushing machine outer casing;

a pair of movable jaw bodies pivotally secured to said crushing machine outer casing;

at least one actuating device mounted on said crushing machine outer casing and coupled to said pair of movable jaw bodies to effect an opening and closing operation of said pair of movable jaw bodies relative to each other; and a crushing blade having a substantially semicircular shape provided at a distal end of each of said movable jaw bodies, each of said crushing blades including:

a rear-side edge having a rear-end edge portion, a front-end edge portion, and a small arcuate edge portion, said rear-end edge portion and said small arcuate edge portion forming a substantially right-angled shape, said small arcuate edge portion located at an apex of said right-angled shape, and a front-side edge generally formed by a large arcuate edge portion;

each of said crushing blades being oriented such that said rear-side edge is located at a position closer to a longitudinally inward direction side of said movable jaw body relative to said front-side edge.

7. A crushing machine according to claim 6, wherein both of said jaw bodies are secured in a pivotal manner.

8. A crushing machine according to claim 6, wherein one of said jaw bodies is angled to define an intermediate portion and wherein an additional crushing blade is positioned in said intermediate portion.

9. A crushing machine according to claim 6, wherein said at least one actuating device is coupled at a location proximate the distal end of one of said jaw bodies.

10. A crushing machine according to claim 6, wherein one of said jaw bodies is bifurcated to include a pair of distal end rising portions, each of said distal end rising portions terminating in a projection, and wherein the other one of said jaw bodies may be pivoted such that said crushing blade is inserted a predetermined distance between said pair of distal end rising portions.

* * * * *